US007025215B2

(12) United States Patent
Bain et al.

(10) Patent No.: US 7,025,215 B2
(45) Date of Patent: Apr. 11, 2006

(54) APPARATUS FOR DRYING SCUBA DIVING GEAR

(76) Inventors: Michael J. Bain, 8500-43rd Ave., Kenosha, WI (US) 53142; Lisa M. Bain, 8500-43rd Ave., Kenosha, WI (US) 53142

( * ) Notice: Subject to any disclaimer, the term of this patent is extended or adjusted under 35 U.S.C. 154(b) by 0 days.

(21) Appl. No.: 10/832,039

(22) Filed: Apr. 26, 2004

(65) Prior Publication Data

US 2005/0236532 A1 Oct. 27, 2005

(51) Int. Cl.
*A47F 7/22* (2006.01)

(52) U.S. Cl. ..... 211/85.31; 248/150

(58) Field of Classification Search ..... 211/85.3, 211/205, 196, 113, 118; 248/158, 150, 151
See application file for complete search history.

(56) References Cited

U.S. PATENT DOCUMENTS 1,525,701 A * 2/1925 Rose et al. ..... 211/196
4,448,378 A * 5/1984 Binfare ..... 248/188.7
4,865,283 A * 9/1989 Parker ..... 248/159
5,458,305 A * 10/1995 Woodward ..... 248/121
6,216,887 B1 * 4/2001 Soo ..... 211/85.7
2004/0181963 A1 * 9/2004 Morris ..... 34/103
2005/0082244 A1 * 4/2005 Ho ..... 211/85.23

FOREIGN PATENT DOCUMENTS

CA 2444459 * 10/2005

* cited by examiner

*Primary Examiner*—Ramon O. Ramirez
(74) *Attorney, Agent, or Firm*—Jansson, Shupe, Munger & Antaramian

(57) ABSTRACT

An apparatus for drying scuba diving gear is provided having a support member and first, second and third hanger sub-assemblies removably, slidably engageable with respect to the support member. The sub-assemblies are in vertical alignment with one another at their point of engagement with the support member. Each sub-assembly is adapted for specific pieces of scuba gear. Preferably, the support member is a vertically disposed shaft telescopically secured to an erectable/collapsible tripod assembly. An apparatus is also disclosed where the support member is a chain assembly having an attachment hook for attachment with respect to an overhead support at one end and a support bar to hold the hanger sub-assemblies upright in engagement with the chain assembly at the other end.

26 Claims, 4 Drawing Sheets

APPARATUS FOR DRYING SCUBA DIVING GEAR

FIELD OF THE INVENTION

This invention is related generally to apparatus for drying wet garments and, more particularly, to apparatus for drying wet scuba diving gear.

BACKGROUND OF THE INVENTION

Interest in the sports of scuba diving and snorkeling continues to grow. Participation in these aquatic activities requires the enthusiast to utilize a wide range of equipment, often referred to as "gear". This equipment includes a wet suit, hot skin, buoyancy compensator as well as other accessories such as diving gloves and boots.

Since these garments can be quite expensive, most divers purchasing it are highly motivated to see that their gear receives proper care at all times. In particular, proper care includes seeing that each piece is treated in the correct manner when left to dry after a dive. Drying scuba gear is preferably done by placing the pieces on individual hangers where the hangers have broad shoulder-like supports. The hangers are then suspended off the ground to allow water to fully drain from the gear and for air to reach all of its surface areas. In doing this, the risk of mold or mildew forming on the diving outfit can be reduced.

Hangers used to dry diving gear, like most clothes hangers, are shaped so that each piece can hang in a manner that avoids any unnecessary folds or creases in the material or fabric from which the garment is made. The broad shoulders of the hangers decrease the likelihood of the type of crease being created that can weaken and damage the material, thereby leading to tears or holes to this equipment.

Although the use of individual hangers to dry and store select pieces of scuba gear is well known, scuba divers would find highly desirable the ability to hang an entire scuba outfit, including large pieces the buoyancy compensator, from a single apparatus. Moreover, there has long been a need for a drying device that does not depend upon the presence of an overhead support, such as a beam or tree limb, from which to suspend the device and its hangers before it can be used. There are many occasions where the diver needs to dry his gear on the beach or in his hotel room and there is either no overhead support or one simply inadequate to handle the combined weight of the wet pieces of equipment hanging from it. This invention meets these needs and overcomes other problems and shortcomings in the prior art.

OBJECTS OF THE INVENTION

It is a primary object of this invention to provide an improved apparatus for drying scuba diving gear that overcomes some of the problems and shortcomings of the prior art.

Another object of this invention is to provide a novel apparatus drying scuba diving gear that is capable of supporting a buoyancy compensator, a wet suit, a hot skin and other diving accessories.

Another object of this invention is to provide an exceptional apparatus for drying scuba diving gear that can be easily erected to stand on the ground whereby the apparatus can be used in locations where there are no overhead supports from which to hang the diving gear.

Another object of this invention is to provide an excellent apparatus for drying scuba diving gear that maintains sufficient separation between each piece of diving gear hanging from the apparatus so as to facilitate improved air circulation around and between the equipment for decreasing the time required to dry the gear.

Another object of the invention is to provide a desirable apparatus for drying scuba diving gear that can be easily disassembled for compact storage and yet is simple to construct, not complicated to maintain, and highly reliable to use.

SUMMARY OF THE INVENTION

This invention is an improved apparatus for drying scuba diving gear. The apparatus comprises a support member and first, second, and third hanger sub-assemblies removably and slidably engageable with respect to the support member. The first sub-assembly is in reference to the one furthest from the top of the support member while the third sub-assembly is the one closest to the top. The hanger sub-assemblies are in vertical alignment with each other at their point of engagement to the support member and each sub-assembly is adapted to specific pieces of scuba gear. It is well understood that scuba gear can include garments such as a buoyancy compensator, a wet suit, a hot skin, boots and gloves.

In certain desired embodiments, the support member is a vertically disposed shaft, preferably where the shaft is telescopically secured to an erectable/collapsible tripod assembly. The term "tripod assembly" as used herein refers to a device having three or more floor-engaging members. Most desirable is where the sub-assemblies are rotatably attached to the shaft. The sub-assemblies can also be slidably removable from the shaft so that the apparatus can be disassembled for compact storage. Highly desirable is where each sub-assembly can be frictionally attached to at least one other sub-assembly.

In certain preferred cases, the first hanger sub-assembly is sized to receive a buoyancy compensator. In other preferred embodiments, the second hanger sub-assembly includes a horizontal support rod and two hanger members. The term "hanger member" as used herein means a broad-shouldered device made from a non-ferrous material from which a garment can be draped or hung.

Highly desirable is where each hanger member of the suit assembly has a hanger-pin situated at its vertex that engages an aperture on the support rod, the hanger members being positioned on opposite portions of the support rod, whereby each hanger member can be slidably removed from the rod to allow the suit assembly to be disassembled for compact storage. In certain preferred cases, each hanger member is specifically sized to fit either a wet suit or a hot skin.

Also desirable is where the third hanger sub-assembly includes at least one accessory-support member. In a more preferred embodiment, the third hanger sub-assembly has two pair of accessory-support members. Most desirable is where each accessory-support member is sized and positioned so that it can receive scuba gear such as a diving boot or a diving glove.

Other highly preferred embodiments of this apparatus find the support member to be comprised of a chain assembly having an attachment hook at its top end and a support bar at its bottom end. The attachment hook is attached to an overhead support to allow the apparatus to hang downward from the support and the first hanger sub-assembly is held upright by the support bar.

A method is also provided by this invention for drying scuba diving gear. The scuba gear can include a buoyancy compensator, a wet suit, a hot skin, diving boots, and diving gloves. The method comprises: (1) providing a disassembled and compactly stored drying apparatus having a first, second and third hanger sub-assemblies and a support member; (2) erecting the support member; (3) rotatably and slidably engaging the sub-assemblies to the support member; (4) placing the buoyancy compensator on the first hanger sub-assembly; (5) placing the wet suit and the hot skin on the second hanger sub-assembly; (6) placing the diving boots and diving gloves on the third hanger sub-assembly; and (7) leaving the buoyancy compensator, wet suit, hot skin, diving boots, and diving gloves in place on the apparatus until dry. More desirable is where the method further includes the steps of removing the scuba gear from the apparatus and then disassembling the apparatus for compactly storing it.

Most preferred is where the support member in this method is a vertically disposed shaft telescopically secured to an erectable/collapsible tripod assembly. Also desirable is where the embodiment of the method finds the support member comprising a chain assembly having an attachment hook at its top end and a support bar at its bottom end. In such embodiments, the attachment hook is attached to an overhead support so that the apparatus can hang downward from the support and the support bar is positioned orthogonal to the chain assembly to allow the first hanger sub-assembly to be held upright by it.

In certain desired embodiments of this method, the second hanger sub-assembly includes a substantially horizontal support rod and two hanger members where each hanger member has a pin situated at its vertex and the support rod has two apertures at opposite ends, each aperture being sized to receive the pin, so that each hanger member can be slidably engaged with the support rod.

DETAILED DESCRIPTION OF PREFERRED EMBODIMENTS

Figure 1:
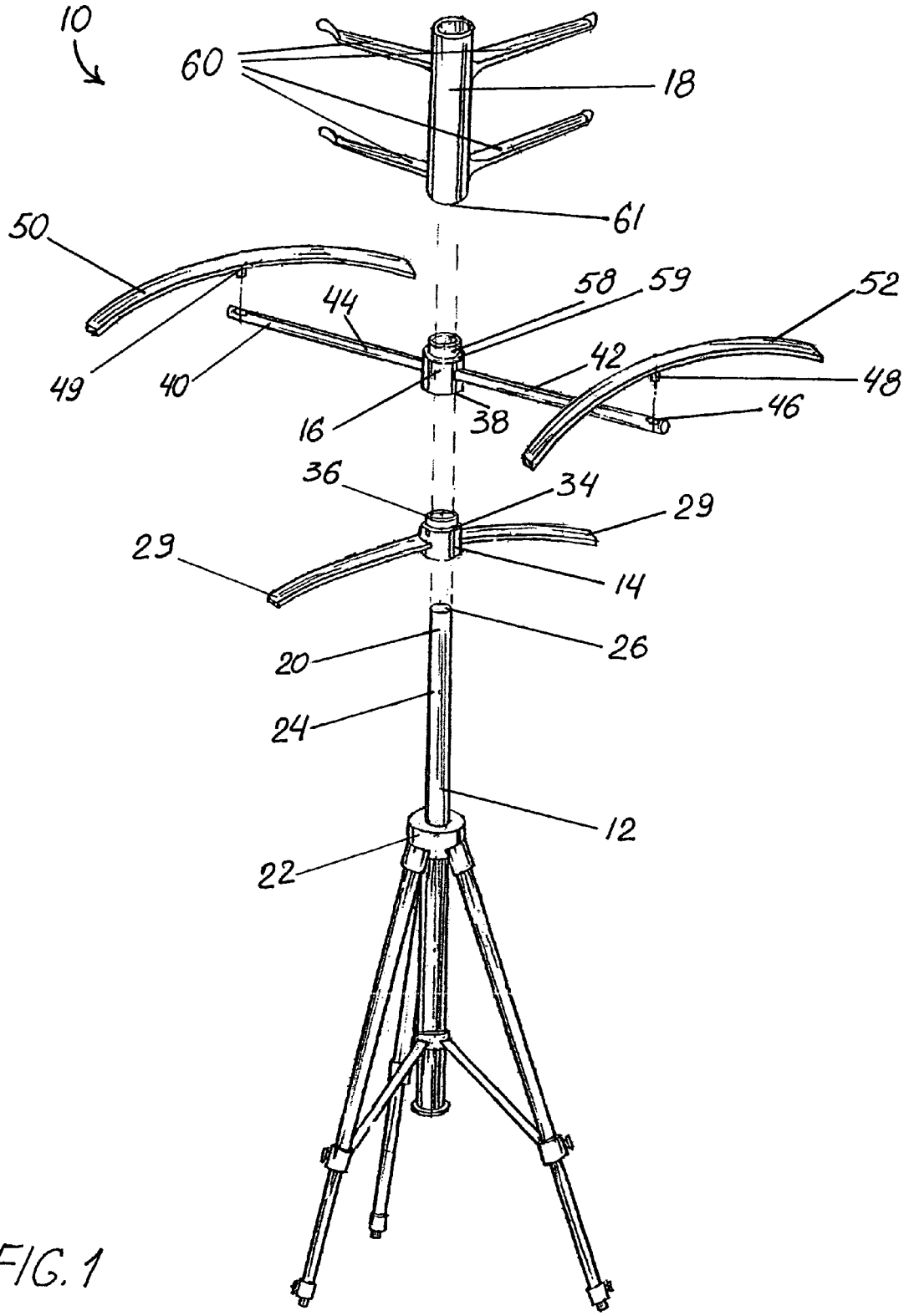
FIG. 1 is an exploded view of a preferred drying apparatus for scuba diving gear in accordance with this invention.
Figure 2:
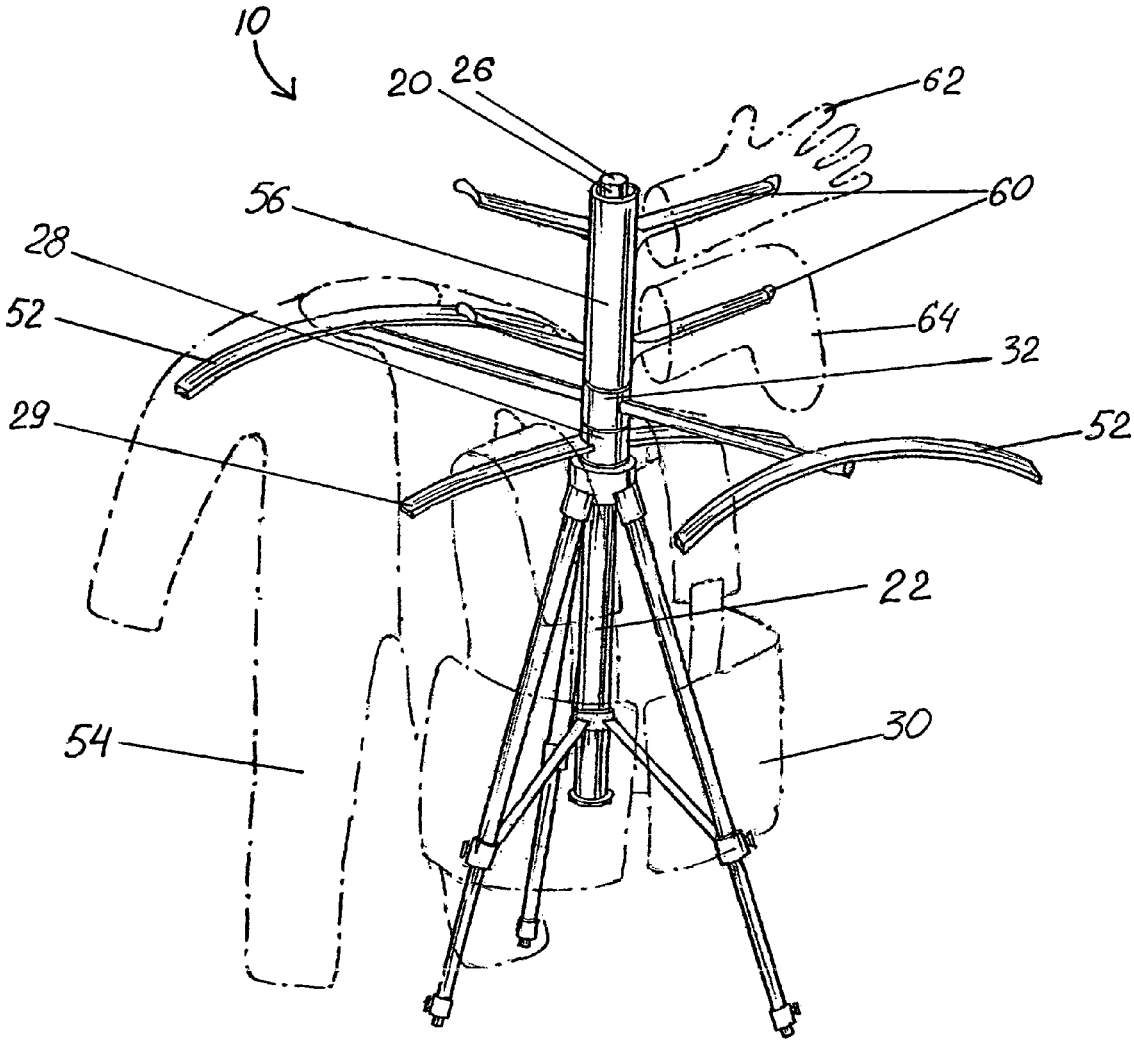
FIG. 2 is a perspective view of the apparatus of FIG. 1.

The drawings illustrate an improved apparatus 10 for drying scuba diving gear in accordance with this invention. Apparatus 10 is comprised of support member 12 and first, second and third hanger sub-assemblies 14, 16, 18. The support member 12 in the preferred embodiment shown in FIGS. 1–2 is shaft 20. Shaft 20 is a rigid structure, vertically mounted to tripod 22 in a manner that allows shaft 20 to telescopically extend or retract axially whenever tripod 22 is respectively erected for use or collapsed for storage.

As seen in FIGS. 1–2, when extended outward, shaft 20 has upper portion 24 and top end 26. First hanger sub-assembly 14 includes tubular first sub-assembly hub 28. Hub 28 is sized to be slidably received by shaft 20 when placed over top end 26. Hub 28 is further sized to rotate at its point of engagement with shaft 20.

Two hanger extensions 29 are rigidly attached to the outer surface of first sub-assembly hub 28, one opposite from the other, in a substantially horizontal configuration. As illustrated in FIG. 2, each hanger extension 29 has a broad upper surface that allows heavy scuba gear such as a buoyancy compensator 30 (shown in phantom) to be hung from both extensions 29.

Second hanger sub-assembly 16 has tubular second sub-assembly hub 32. Hub 32 is also sized to be slidably received by shaft 20 by placing hub 32 over top end 26 and to rotate about shaft 20 after so engaged to it. First sub-assembly hub 28 has an first hub-upper edge 34 that is provided with first flange 36. First flange 36 is sized to frictionally attach to, i.e. snap onto, the second hub-bottom end 38 of second sub-assembly hub 32.

First and second rod portions 40, 42 of support rod 44 are rigidly secured to the outer surface of second sub-assembly hub 32. Each rod portion 40, 42 is positioned opposite the other so as to be in substantial horizontal alignment. Each rod portion 40, 42 is provided at its distal end with a hanger-aperture 46. As seen in FIG. 1, each hanger-aperture 46 is sized to slidably receive hanger-pin 48 at hanger-vertex 49 on each hanger member 50. Each hanger member 50 has a broad, substantially horizontal shoulder section 52 of sufficient length and width to allow scuba garments such as a wet suit 54 (as shown in phantom in FIG. 2) or hot suit to be supported on apparatus 10 without creasing or otherwise damaging the fabric of the garment.

Hanger-aperture 46 is preferably located at the distal end of each rod portion 40, 42. This allows scuba gear drying on hanger member 50 to have physical separation from gear drying on first hanger sub-assembly 14. It will be appreciated that a plurality of hanger-apertures can be provided along the length of rod portions 40, 42 to allow each hanger member 50 to be placed at any one of a number of positions on either side of shaft 20. In such an embodiment, choice of position will be based on factors that include the weight of the gear being hung and the degree of separation desired from other pieces being dried.

Third hanger sub-assembly 18 is provided with tubular third sub-assembly hub 56. Hub 56 is similarly sized to slidably engage shaft 20 and to rotate about shaft 20 at its point of engagement. Third sub-assembly 18 is placed onto shaft 20 above second sub-assembly 16. Second hanger sub-assembly 16 includes second flange 58 at second hub-upper edge 59 that interconnects or mates with third hub-bottom end 61 of third sub-assembly 18.

As illustrated in FIGS. 1–2, third hanger sub-assembly 18 has two pair of accessory-support members 60. Each pair is rigidly attached to the exterior surface of third hub 56 with each accessory-support member 60 pointing upward. One pair of accessory-support member 60 is positioned at a level below the other pair along the length of third hub 56. Each accessory-support member 60 of any one pair is preferably in horizontal registry with the other member of that pair.

Each accessory-support member 60 is sized to support pieces of gear that can be draped over such member. Such pieces include a diving glove 62 or diving boot 64 (as shown in phantom in FIG. 2). With the opening to glove 62 or boot 64 pointing downward, accessory-support member 60 allows water to easily drain from the gear while facilitating drying by permitting air to circulate inside each piece.

It will be appreciated that upper portion 24 of shaft 20 will preferably have a length substantially equal to the combined lengths of hubs 28, 32, 56. For greater separation between hanger sub-assemblies 14, 16, 18, a longer upper portion 24 can be used in combination with longer tubular hubs 28, 32, 56. As an alternative to elongating hubs 28, 32, 56 in such an embodiment, tubular spacer units (not shown) can be placed over shaft 20 between hanger sub-assemblies 14, 16, 18 to achieve the desired separation.

Figure 3:
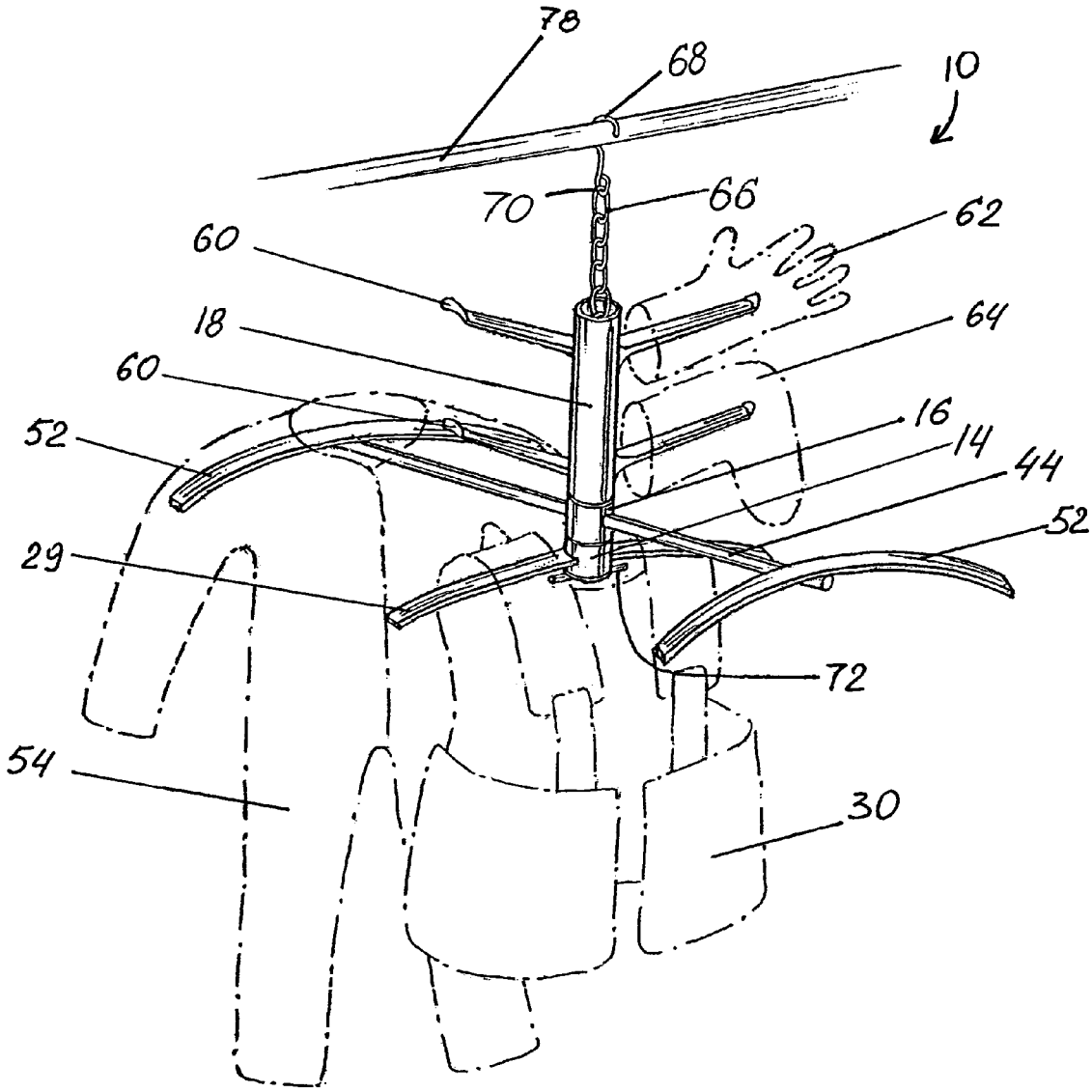
FIG. 3 is a perspective view of another preferred drying apparatus for scuba diving gear in accordance with this invention having a chain assembly as the support member.
Figure 4:
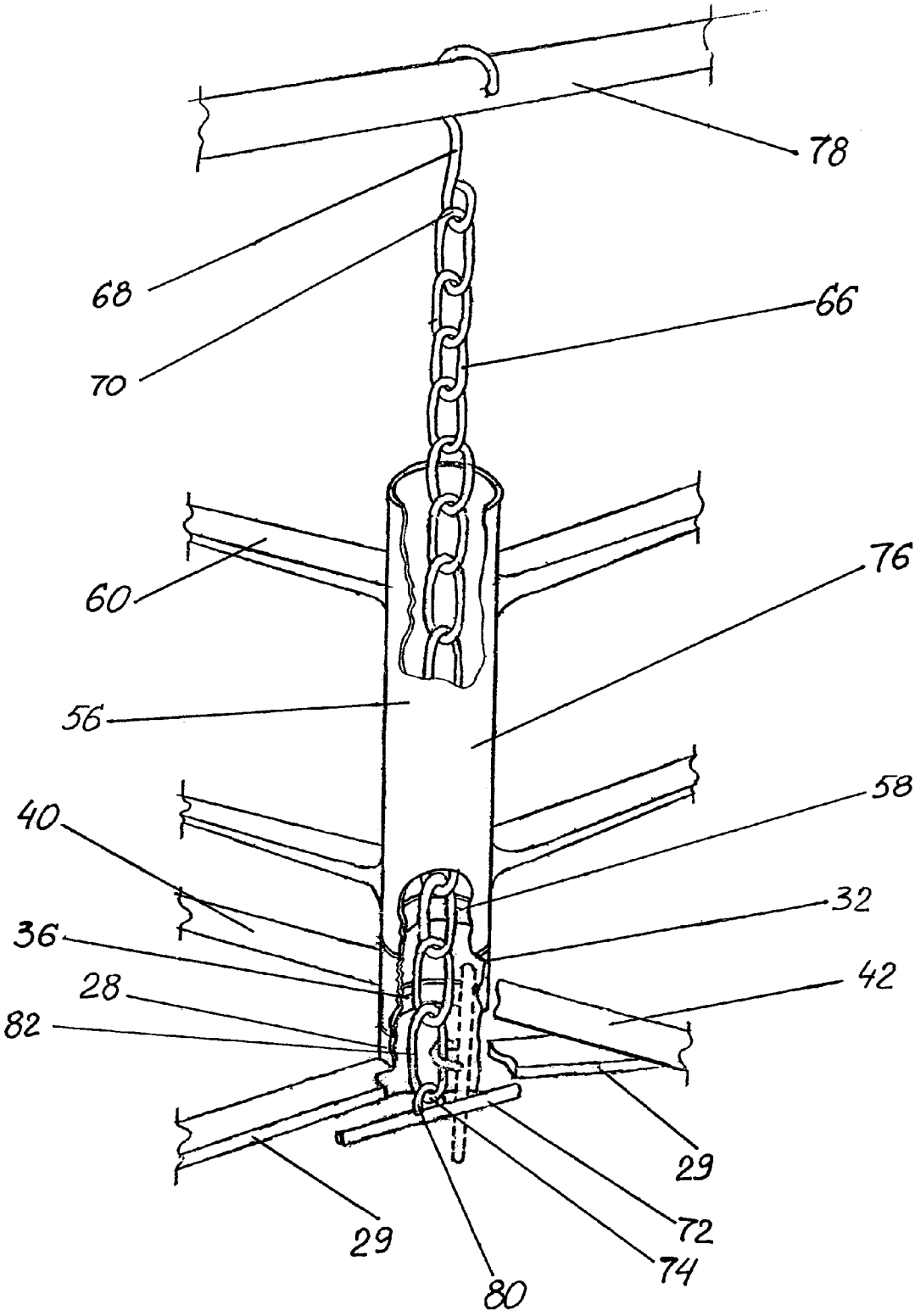
FIG. 4 is a detailed view of the apparatus of FIG. 3 with a partial cut-out of the hanger sub-assemblies.

As illustrated in FIGS. 3–4, another embodiment of the present invention finds support member 12 to be chain assembly 66. Chain assembly 66 has attachment hook 68 at its top end 70 and support bar 72 at its bottom end 74. Attachment hook 68 is fastened to an overhead support 78 such as a beam, bar or overhead tree branch. Support bar 72 includes split ring 80 that encircles bottom link 82 on chain assembly 66.

In assembling apparatus 10 in accordance with this embodiment, it is preferable to first have hanger sub-assemblies 14, 16, 18 snapped together to form vertical stack 76 in a manner where first hanger sub-assembly is at the bottom and third sub-assembly 18 is at the top. As shown in FIG. 4, split ring 80 is sized to permit it to slide along link 82. Movement of split ring 80 to a vertical portion of link 82 also positions support bar 72 in a vertical orientation (as shown in phantom). In this orientation, vertical stack 76 can be threaded or slid upward over chain assembly 66. One can appreciate that hanger sub-assemblies 14, 16, 18 can also be individually threaded onto chain assembly 66 in this manner where they are then snapped together to form vertical stack 76.

After hanger sub-assemblies 14, 16, 18 have been slid onto chain assembly 66, split ring 80 is allowed to drop down to the bottom of link 82. This movement of split ring 80 places support bar 72 in the horizontal configuration seen in FIG. 4, whereby first hanger sub-assembly 14 of vertical stack 76 is supported by support bar 72 and each of the hanger sub-assemblies is thereby prevented from sliding off chain assembly 66.

It will be appreciated from the manner of assembly of apparatus 10 in both embodiments that it can be easily disassembled into its component parts following use. Each part is sized to permit apparatus 10, when disassembled to be compactly stored in a traveling case such as a sports duffle bag.

Given the expected use of an apparatus in accordance with this invention to dry scuba gear wet with salt water, the component parts of apparatus 10 are preferably made from a non-ferrous or low corrosion material such as aluminum or plastic.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. An apparatus for drying scuba diving gear comprising one support member and first, second and third hanger sub-assemblies removably, slidably engageable with respect to the support member, wherein:

a the support member has a top end, the first sub-assembly being most distal from the top end and the third sub-assembly being least distal from the top end;

the sub-assemblies are in vertical alignment with one another at their point of engagement; and each sub-assembly is adapted for directly engaging and supporting specific pieces of gear to be dried, whereby the sub-assemblies can be slidably removed from the support member to disassemble the apparatus after each piece of gear is dried.

2. The apparatus of claim 1 wherein the support member is a vertically disposed shaft.

3. The apparatus of claim 2 wherein the shaft is telescopically secured to an erectable/collapsible tripod assembly.

4. The apparatus of claim 3 wherein the sub-assemblies are rotatably attached with respect to the shaft.

5. The apparatus of claim 4 wherein the sub-assemblies and the shaft are sized such that the apparatus can be disassembled for compact storage.

6. The apparatus of claim 1 wherein the support member comprises a chain assembly having top and bottom ends, an attachment hook at the top end, and a support bar at the bottom end, whereby the attachment hook is attached with respect to an overhead support to allow the apparatus to hang downward from the support and the first hanger sub-assembly is held upright by the support bar.

7. The apparatus of claim 6 wherein:

the first hanger sub-assembly is sized to receive a buoyancy compensator; the second hanger sub-assembly has a substantially horizontal support rod and two hanger members, each hanger member being sized to receive scuba gear wherein the scuba gear is a wet suit or a hot skin; and the third hanger sub-assembly has two pair of accessory-support members, each accessory-support member being sized to receive scuba gear wherein the scuba gear is a diving boot or a diving glove.

8. A method for drying scuba diving gear comprising:

providing a disassembled and compactly stored drying apparatus having first, second and third hanger sub-assemblies and one support member, each sub-assembly being adapted for directly engaging and supporting specific pieces of gear;

erecting the support member;

rotatably and slidably engaging the sub-assemblies to the support member;

placing a buoyancy compensator on the first hanger sub-assembly;

placing a wet suit and a hot skin on the second hanger sub-assembly;

placing diving boots and diving gloves on the third hanger sub-assembly; and leaving the buoyancy compensator, wet suit, hot skin, diving boots, and diving gloves in place until dry.

9. The method of claim 8 further comprising the steps of removing the scuba diving gear from the apparatus and slidably removing the sub-assemblies from the support member to disassemble the apparatus.

10. The method of claim 8 wherein the support member is a vertically disposed shaft telescopically secured to an erectable/collapsible tripod assembly, the assembly having a hub defining an opening to an annular sleeve extending downward from the hub, the sleeve being sized to receive the shaft such that the shaft is substantially refracted within the sleeve when the assembly is collapsed.

11. The method of claim 8 wherein:

the support member comprises a chain assembly having top and bottom ends, an attachment hook at the top end, and a support bar at the bottom end;

the erecting step includes attaching the attachment hook with respect to an overhead support to allow the apparatus to hang downward from the support; and the engaging step includes positioning the support bar orthogonal to the chain assembly, whereby the sub-assembly most distal from the overhead support is held upright by the support bar.

12. An apparatus for drying scuba diving gear comprising a vertically disposed shaft and first, second and third hanger sub-assemblies wherein:

the sub-assemblies are slidably engageable and rotatably attached with respect to the shaft;

the shaft is telescopically secured to an erectable/collapsible tripod assembly and has a top end, the first sub-assembly being most distal from the top end and the third sub-assembly being least distal from the top end;

the sub-assemblies are in vertical alignment with one another at their point of engagement and each sub-assembly is frictionally attached to at least one other sub-assembly;

each sub-assembly is adapted for specific pieces of gear; and the sub-assemblies are slidably removable from the shaft such that the apparatus can be disassembled for compact storage.

13. The apparatus of claim 12 wherein the first hanger sub-assembly is sized to receive a buoyancy compensator.

14. The apparatus of claim 12 wherein the second hanger sub-assembly includes a substantially horizontal support rod and two hanger members.

15. The apparatus of claim 14 wherein:

each hanger member has a vertex and a hanger-pin situated at the vertex; and the support rod is provided with at least two hanger-apertures at opposite ends of the support rod, each hanger-aperture sized to receive one hanger-pin, whereby the hanger-pins are slidably inserted into separate hanger-apertures at opposite portions of the support rod, each hanger member being slidably engaged with respect to the support rod to allow the hanger member to be disassembled from the second hanger sub-assembly for compact storage.

16. The apparatus of claim 15 wherein each hanger member is sized to receive scuba gear wherein the scuba gear is a wet suit or a hot skin.

17. The apparatus of claim 15 wherein the support rod includes first and second rod portions spaced apart by the shaft and each portion has a plurality of hanger-apertures such that each hanger member can be positioned at varying distances from the shaft.

18. The apparatus of claim 12 wherein the third hanger sub-assembly includes at least one accessory-support member.

19. The apparatus of claim 18 wherein the third hanger sub-assembly has two pair of accessory-support members.

20. The apparatus of claim 19 wherein each accessory-support member is sized to receive scuba gear wherein the scuba gear is a diving boot or a diving glove.

21. A method for drying scuba diving gear comprising:

providing a disassembled and compactly stored drying apparatus having first, second and third hanger sub-assemblies and a support member, the second hanger sub-assembly including a substantially horizontal support rod and two hanger members, each hanger member having a vertex and a hanger-pin situated at the vertex and the support rod having two hanger-apertures at opposite ends, each hanger-aperture being sized to receive one hanger-pin such that each hanger member is slidably engageable with the support rod;

erecting the support member;

rotatably and slidably engaging the sub-assemblies to the support member;

placing a buoyancy compensator on the first hanger sub-assembly;

placing a wet suit and a hot skin on the second hanger sub-assembly;

placing diving boots and diving gloves on the third hanger sub-assembly; and leaving the buoyancy compensator, wet suit, hot skin, diving boots, and diving gloves in place until dry.

22. The method of claim 21 wherein each sub-assembly is frictionally attached to at least one other sub-assembly.

23. An apparatus for drying scuba diving gear comprising a vertically-disposed unitary shaft having a longitudinally uniform diameter and first, second and third hanger sub-assemblies removably, slidably engageable with respect to the shaft, wherein:

the shaft has a top end, the first sub-assembly being most distal from the top end and the third sub-assembly being least distal from the top end;

the sub-assemblies are in vertical alignment with one another at their point of engagement; and each sub-assembly is adapted for directly engaging and supporting specific pieces of gear to be dried.

24. The apparatus of claim 23 wherein the shaft is telescopically secured to an erectable/collapsible tripod assembly, the assembly having an annular sleeve sized to receive the shaft such that the shaft is substantially refracted within the sleeve when the assembly is collapsed.

25. The apparatus of claim 23 wherein each sub-assembly abuts at least one other sub-assembly at their point of engagement.

26. The apparatus of claim 23 further comprising tubular spacer units removably and slidably engageable with respect to the shaft, each sub-assembly being frictionally attached to at least one spacer unit.

* * * * *

UNITED STATES PATENT AND TRADEMARK OFFICE

CERTIFICATE OF CORRECTION

PATENT NO. : 7,025,215 B2
APPLICATION NO. : 10/832039
DATED : April 11, 2006
INVENTOR(S) : Michael J. Bain It is certified that error appears in the above-identified patent and that said Letters Patent is hereby corrected as shown below:

In the Claims:
Column 8, line 40, delete the word “refracted” and replace with the word - -retracted --.

Signed and Sealed this

Twenty-second Day of August, 2006

JON W. DUDAS
*Director of the United States Patent and Trademark Office*